United States Patent [19]

Reynolds

[11] 4,334,358

[45] Jun. 15, 1982

[54] VIBRATION DAMPENED SAW BARS

[75] Inventor: Michael J. Reynolds, Oregon City, Oreg.

[73] Assignee: Omark Industries, Inc., Portland, Oreg.

[21] Appl. No.: 179,086

[22] Filed: Aug. 18, 1980

[51] Int. Cl.[3] ..... B27B 17/04

[52] U.S. Cl. ..... 30/387

[58] Field of Search ..... 30/382, 383, 384, 385, 30/386, 387, 371

[56] References Cited

U.S. PATENT DOCUMENTS 2,962,061 11/1960 Nielsen ..... 30/387 X 3,829,971 8/1974 Anderson ..... 30/383

3,949,475 4/1976 Tokarz ..... 30/387

*Primary Examiner*—Jimmy C. Peters

*Attorney, Agent, or Firm*—Klarquist, Sparkman, Campbell, Leigh, Whinston & Dellett

[57] ABSTRACT

Chain saw bars having overlapping slots adjacent locations where the saw chain leaves the driving sprocket and in the region of the nose end of the bar are provided. In these areas, where the chain tends to pound against the bar, the slots dampen the vibrations between the outer portions of the bar rails and the interior of the bar and greatly reduce noise emission. The slots also provide cooling of the saw bar.

30 Claims, 15 Drawing Figures

VIBRATION DAMPENED SAW BARS

BACKGROUND OF THE INVENTION

The present invention relates to saw bars for chain saws and more particularly to saw bars exhibiting minimized vibration characteristics.

An extensively used type of chain saw includes an elongated saw bar extending from a driving sprocket toward a rounded outer or nose end. The saw bar has grooves along its upper and lower portions and along its nose end for receiving the drive links of a saw chain. Side links of the chain ride along the rails of the bar. The portions of the saw chain leaving the sprocket and the nose end of the bar are often slack and slap or pound against the adjacent rail portions of the bar, causing considerable noise to be generated and resulting in more wear to these portions of the rails than would be desirable.

SUMMARY OF THE INVENTION

A chain saw bar has substantially straight rail portions extending to and from a drive sprocket as well as a rounded nose portion, and is further provided with vibration dampening portions interposed between the bar's inner or body portion and its outer rail portions at locations where the chain tends to slap as it is driven by the drive sprocket. As a result, impact on the bar is dampened, noise is reduced and user fatigue is lessened. Also, the saw bar operates at a lower temperature.

A chain saw bar forming a more specific embodiment of the invention has rows of slots in the areas thereof near portions of rails engaged by a saw chain where the saw chain leaves a driving sprocket or where it leaves the rounded nose portion of the saw bar.

A chain saw having a saw bar forming an even more specific embodiment of the invention includes a body on which the saw chain is mounted in a position extending from a drive sprocket along substantially straight upper portions of rails, around rounded nose portions of the saw bar and along substantially straight lower portions of the rails to the sprocket, the saw bar having overlapping, somewhat triangular patterns of slots or voids adjacent the portions of the rails near where the chain leaves the sprocket and near the nose portion of the bar to dampen vibrations between the rails and the body of the bar.

It is accordingly an object of the present invention to provide an improved saw bar having vibration dampening features.

It is another object of the present invention to provide an improved saw bar which is effective to reduce the operating noise of a chain saw.

It is another object of the present invention to provide an improved saw bar for rendering a chain saw less fatiguing to operate.

It is another object of the present invention to provide an improved saw bar which is less subject to wear as compared with prior art saw bars.

It is another object of the present invention to provide an improved saw bar having enhanced self-cooling properties.

The subject matter which I regard as my invention is particularly pointed out and distinctly claimed in the concluding portion of this specification. The invention, however, both as to organization and method of operation, together with further advantages and objects thereof, may best be understood by reference to the following description taken in connection with the accompanying drawings wherein like reference characters refer to like elements.

DRAWINGS

DETAILED DESCRIPTION

Figure 2:
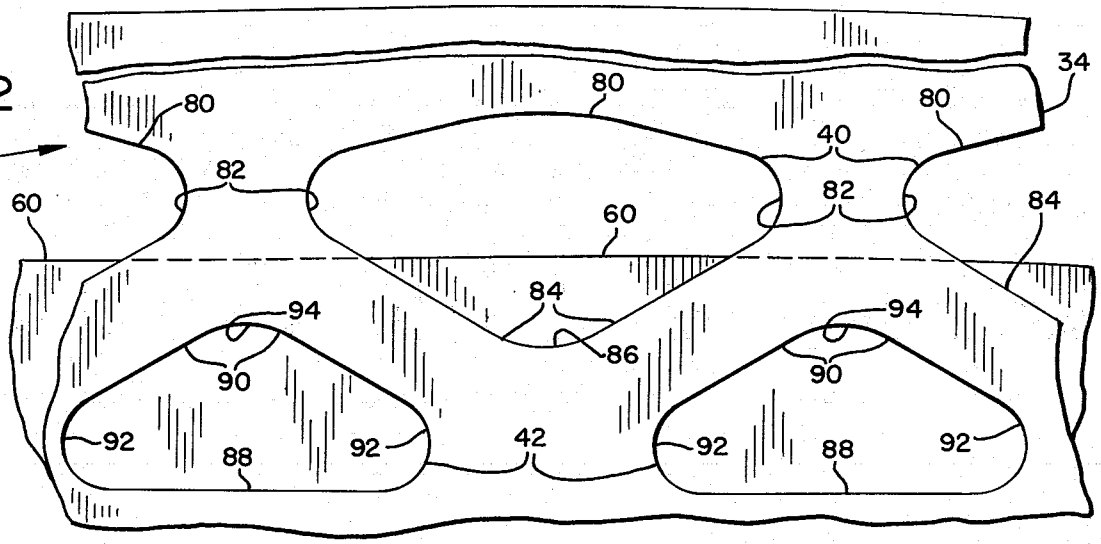
FIG. 2 is an enlarged, fragmentary side elevational view of the saw bar of FIG. 1.
Figure 3:
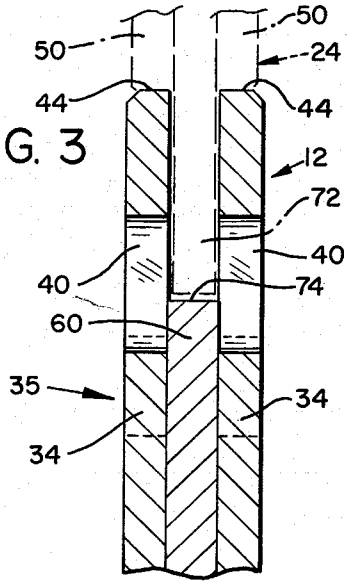
FIG. 3 is an enlarged, vertical sectional view taken along line 3—3 of FIG. 1.
Figure 1:
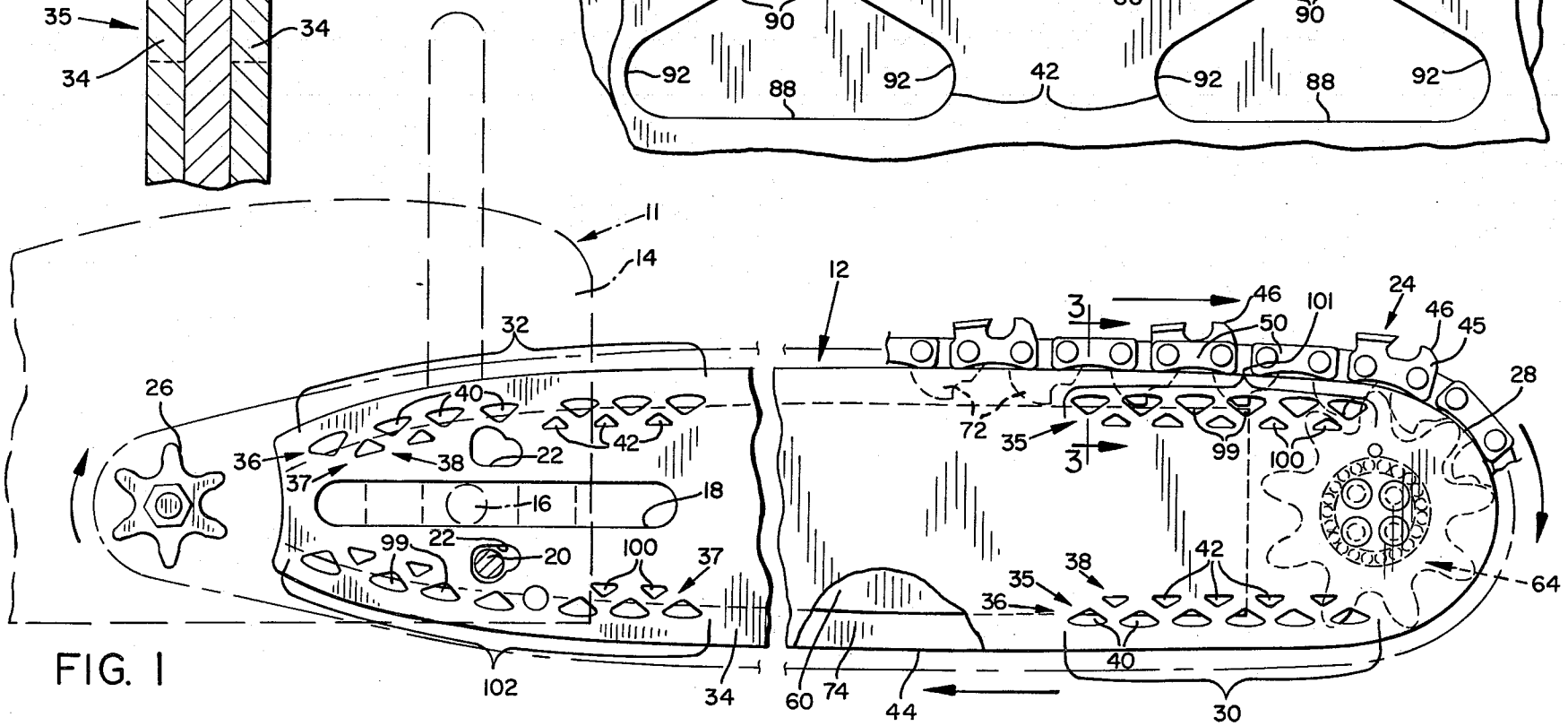
FIG. 1 is a fragmentary, side elevational view of a chain saw having a chain saw bar forming one embodiment of the invention.

Referring to the drawings and particularly to FIGS. 1 to 3, a chain saw 11 has a saw bar 12 forming a specific embodiment of the invention. The saw bar is attached to a frame 14 of the chain saw in the usual manner by a nut (not shown) on a stud 16 extending through a slot 18 in the saw bar. Typically a pin 20 of a tension device extends through a hole 22 in the saw bar for adjusting the bar to tension a saw chain 24 on the saw bar and on drive sprocket 26. When the chain saw is operated, the sprocket advances the chain around the saw bar in a clockwise direction, as viewed in FIG. 1, and the portions of the chain which have just come off sprocket 26 and rounded nose 28 of the saw bar tend to move out from the saw bar and then slap back, especially against portions 30 and 32 of the saw bar, which portions are designated "impact areas". This tendency is particularly severe if, as frequently occurs, the chain is not tensioned sufficiently on the saw bar. This slapping causes objectionable noise and also wear on conventional saw bars. However, side laminates 34 of the saw bar 12 have, substantially co-extensive with impact areas, vibration dampening areas 35 and 37 formed, according to this embodiment, by rows 36 and 38 of overlapping openings or slots 40 and 42, which dampen vibrations from the impact of the saw chain on guide portions of rails 44 extending along the saw bar. This greatly reduces noise and also wear on the rails, on side portions 45 of cutter links 46, and on side links 50 of the saw chain.

The side laminates 34 of the saw bar 12 are welded to a core laminate 60 as is conventional in the art, and a conventional sprocket-like nose roller 64 is mounted rotatably in the nose area of the saw bar. Drive links 72 of the chain 24 travel in a peripheral groove 74 formed by the side and core laminates. The slots 40 in the embodiment of FIGS. 1–3 extend outwardly substantially beyond the adjacent portions of the outer edge of the core laminate 60 and the slots have curved outer sides 80 joined by fillets 82 to straight inner sides 84 connected by fillets 86 so as to form inwardly directed, generally triangular slots. The slots 42 also are generally triangular, being slightly smaller, and have substantially straight sides 88 and 90 joined by fillets 92 and 94. Slots 42 are pointed outwardly and overlap the slots 40.

The overlapping rows of slots are effective in vibrationally isolating the portions of the rails along the impact areas to dissipate vibrations and reduce noise. The slots provide the rail areas with dynamic freedom to absorb the impact, with the slots making the rail areas adjacent the impact areas more compliant so that they will yield or flex sufficiently to dissipate energy and prevent transfer of energy to the more inward portions of the saw bar. This vibration in prior art saw bars has been a leading cause of noise emission in chain cutting systems through vibrational excitation of the bar structure.

The distance of the slots from the rails is not critical and may be from 0.07 inches to 0.25 inches. While the illustrated saw bar 12 is of the laminated type, the same isolation can be achieved in solid bars by pitting, or by forming the slots clear through the bar. The laminates 34 and 60 may be of 9260 high carbon alloy steel with the hardness of the rail portions being from Rockwell A 77,5 to Rockwell A 81,5 and with the rest of the bar having a hardness of from Rockwell C 40 to Rockwell C 44. It is understood both side laminates 34 may have substantially the same slot configuration, although only one is illustrated in the drawings.

The saw bar 12 is invertible and has rows of slots 99 and 100 adjacent areas 101 and 102 which would be the impact areas when the bar is inverted. That is, the bar is structurally symmetrical for inverting its position. However, a saw bar according to the present invention need not be symmetrical nor include slot patterns that coincide from side to side.

In addition to noise reduction advantages, the construction according to the present invention is found to provide other desirable features as well. The vibration dampening achieved results in less fatigue to the operator or user, particularly when the chain saw employing the saw bar according to the present invention is used for extended periods of time. Thus, the vibration dampening prevents or substantially lessens the vibration of the central saw bar as would otherwise be conveyed to the operating frame and the operator. Also, as a result of the flexure of the rail portions, saw bars according to the present invention are less subject to wear and damage than conventional or prior art saw bars, and consequently are characterized by a longer expected operating life before wearing out. Friction is reduced since the bar is more compliant. As a further advantage, it is found the saw bar is self-cooling and appears to draw air through the slots as a consequence of movement of the saw chain along the saw bar groove. Morever, the slots or voids provide cooling areas, and reduce heat conduction from the saw bar rails to the central portion of the saw bar, with friction also being lessened as mentioned above. The net result is a much cooler operating bar which can be handled more easily by the user without encountering excessively elevated temperatures.

Although the embodiment of the invention having the configuration of the slots illustrated in FIGS. 1, 2 and 3 has been found to be of particular advantage, the openings may alternatively take other forms as illustrated in FIGS. 4–15. A complete saw bar is not illustrated in FIGS. 4–15, but rather only a portion of each saw bar having a vibration dampening area co-extensive with an impact area. These configurations are effective in vibrationally isolating the portions of the rails of the saw bar along the impact areas to dissipate vibrations, prevent noise, and provide other advantages of the present invention.

Figure 4:
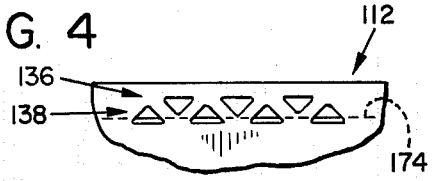
FIGS. 4–15 are fragmentary side elevational views of chain saw bars forming alternate embodiments of the invention.

The embodiment of FIG. 4 comprises a saw bar 112 having closely spaced or intermeshing rows 136 and 138 of overlapping, generally triangular slots, wherein all the sides are straight. It will be observed the bottom of the groove 174 between saw bar laminates in this embodiment is adjacent the slots of a lower row 138 rather than upper row 136, the slots in FIG. 4 being somewhat smaller and the rows of slots being more fully intermeshed than in the previous embodiment.

Figure 5:
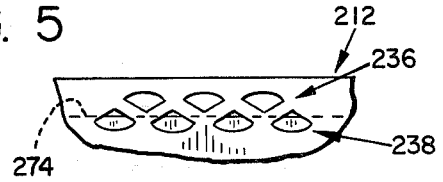

The saw bar 212 of FIG. 5 includes rows 236 and 238 of wedge shaped, overlapping slots, wherein the slots in each row have curved outer sides but are otherwise somewhat similar in configuration to the slots of FIGS. 1–3. The position of the groove bottom is illustrated by the full and dashed line in this and each of the following drawings. In the FIG. 5 embodiment, the bottom of groove 274 intersects the slots of row 238.

Figure 6:
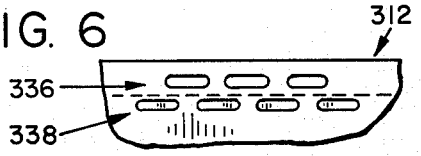
Figure 7:
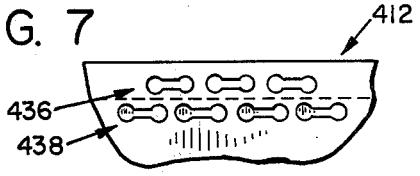

In FIG. 6, rows 336 and 338 of overlapping elongated, straight slots are provided in the saw bar 312, with the slots extending in generally parallel relation to the rails of the saw bar. The ends of these straight slots are somewhat rounded. Similar rows 436 and 438 of slots in FIG. 7 have enlarged, somewhat bulbous, overlapping ends providing a "dumbbell" type appearance.

Figure 8:
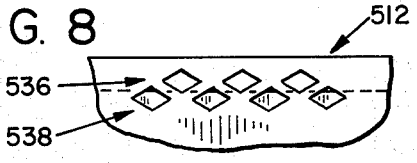
Figure 9:
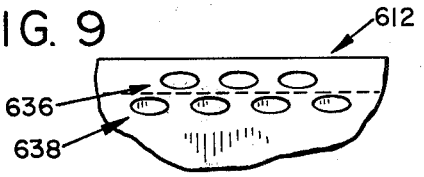

In FIG. 8, rows 536 and 538 of slots are diamond shaped, with the rows overlapping and intermeshing to a considerable degree. The rows 636 and 638 of overlapping slots in FIG. 9 are elliptical or oval shaped with the longer axis of each ellipse being substantially parallel to the edge or rails of the saw bar 612.

Figure 10:
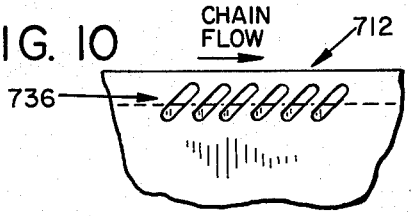

In the embodiment of FIG. 10, saw bar 712 is provided with a single row 736 of overlapping, elongated, substantially straight, sloping slots. The slots are oriented at an angle of approximately forty-five degrees to the adjacent portion of the saw bar rail or edge, and are slanted or angularly displaced away from the oncoming chain and toward the direction of chain travel. Thus the slots make an acute angle with the path of the oncoming chain such that the portion of a slot nearest the saw bar edge will be passed over by the chain after the chain passes over portions of the same slot farther away from the edge of the saw bar. This provides more compliance in the saw bar laminates in response to impact of the saw chain. If the slots were slanted in the opposite direction, or were substantially perpendicular to the edge of the saw bar, substantially less compliance and vibration isolation would be realized.

Figure 11:
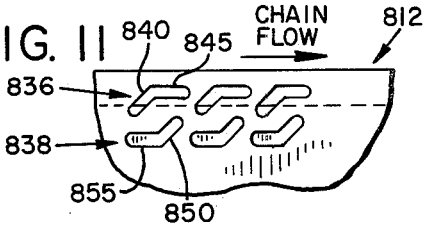

The embodiment of FIG. 11 includes rows 836 and 838 of L-shaped, overlapping slots. For example, the slots of outer row 836 include legs 840 which are angular and substantially similar in orientation to the slots of FIG. 10. The slots are also provided with straight legs 845 generally paralleling the rails and disposed in intersection with legs 840. The slots of row 838 are substantially the inverse of the slots in row 836 and would form a parallelogram therewith if the sides of both slots were extended. The slots of row 838 include angular legs 850 parallel to legs 840, and straight legs 885 parallel to the rails of the saw bar. It will be noted the angular legs 840 and 850 in each case are slanted or angularly displaced away from the oncoming chain and toward the direction of chain travel to provide better compliance. As a further embodiment, the slots of row 836 may be provided on a saw bar without the slots of row 838, especially with the angular legs extending farther downwardly so the straight leg of an adjoining slot overlaps the angular leg to a greater extent. Alternatively, row 838 may be used alone.

Figure 12:
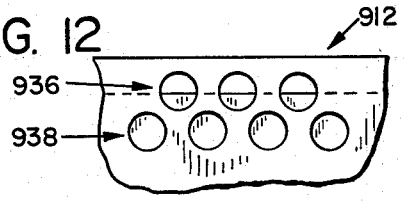
Figure 13:
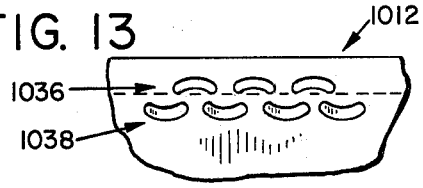

In FIG. 12, a saw bar 912 is provided with rows 936 and 938 of overlapping circular slots, while in the embodiment of FIG. 13, rows 1036 and 1038 of crescent shaped slots are disposed in overlapping relation with the concave sides thereof facing one another.

Figure 14:
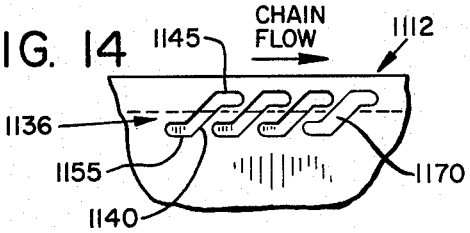

In the embodiment of FIG. 14, a row of S-shaped slots is disposed along the edge of saw bar 1112. Each of the slots includes an angular portion 1140 slanted away from the oncoming chain and toward the direction of chain travel, and the ends of leg 1140 are extended into straight slot portions 1145 closest to and parallel to the edge of the saw bar and straight slot portions 1155 also parallel to the edge of the saw bar and extending in the opposite direction. It will be noted that the straight legs of each slot overlap legs of the adjoining slot.

Figure 15:
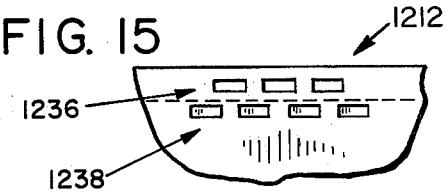

In the FIG. 15 embodiment, rows 1236 and 1238 of overlapping rectangular slots are substantially parallel to the edge of the saw bar. These slots and the arrangement thereof are substantially similar to those of FIG. 6, but are provided with square corners in FIG. 15.

As apparent from the several above-described saw bars, there is a wide latitude in dimension and size of the slots so long as the patterns give dynamic freedom to the rail portions to absorb the impact. The slotted areas make the rail portions along the impact areas more compliant so that they yield or flex more, and the increased flexure prevents the transfer of energy into the bars as vibrational excitation. It is generally desired, however, that the slots have elongated features parallel to the rails or having a substantial component parallel to the rails for enhancing the compliance of the rail portions. The rail portions may be locally hardened as is well-known in the art.

Although the above described embodiments generally employ two rows of slots to achieve the vibration dampening areas, in many cases a single row of slots can be employed, especially if shaped and oriented to provide desired overlapping, e.g. as in the embodiments of FIGS. 10 and 14. Spaced slots without an overlapping configuration are less advantageous because zones of noncompliant saw bar rail would extend between the impact area portion of the saw bar and the inner portion thereof, conducting vibration. Among the various structures described, the triangular slot structures of FIGS. 1–3 and 4 and 5 are preferred since providing the desired compliance and vibration isolation while also being strong mechanically. Stress is more uniformly distributed in the triangular type structure.

Although the saw bar slots are suitably left as openings through the side portions of a laminated saw bar as hereinbefore described, certain further advantages are procured by filling the slots with a somewhat resilient material. Referring, for example, to FIG. 14, a slot 1170 is illustrated as filled with such a resilient material, it being understood that such material has approximately the same thickness as the side portion or laminate of the saw bar through which the slot is provided. It is also understood all of the slots in a given saw bar are desirably filled with the resilient material, including corresponding slots in both side laminates. The material inserted in the slots prevents leakage of lubricating oil as conventionally provided along the saw bar groove (74 in FIG. 1). Moreover, the inserted material has the effect of further reducing noise as may be caused by air turbulence in the open slots, and also prevents the entrainment of chips or sawn material in the slots as might hinder smooth movement of the saw bar in the saw kerf. It is understood the provision of the flexible insert material is applicable to any of the embodiments of the present invention as hereinbefore described.

Among the materials applicable for the flexible inserts are (1) polyurethane foam plastics, (2) vinyls or leaded vinyls, (3) natural or synthetic rubbers, or (4) silicone sealants. In a particular embodiment, a "rigid" urethane foam was employed having the designation Biwax 82.460 as manufactured by the Biwax Corporation, Des Plaines, Illinois. Another material which may be used comprises an adhesive tape overlay. In such case a thin flexible tape material is adhesively attached over the slots on the outside of the saw bar rather than being inset within the slots.

While I have shown and described several embodiments of my invention, it will be apparent to those skilled in the art that many changes and modifications may be made without departing from my invention in its broader aspects. I therefore intend the appended claims to cover all such changes and modifications as fall within the true spirit and scope of my invention.

I claim:

1. A chain saw bar having rail portions and a body portion bounded by the rail portions, the rail portions having high impact areas, the bar having vibration dampening portions interposed between the rail portions and the inner body portion to retard transmission of vibrations from the rail portions to the body portion, said vibration dampening portions comprising rows of slots wherein said rows are generally parallel to the adjacent portions of the rail portions and the slots overlap one another such that perpendicular joinder of said rail portions to said body portion by noncompliant saw bar zones is avoided in said vibration dampening portions.

2. The chain saw bar according to claim 1 wherein the slots are generally triangular in shape.

3. The chain saw bar according to claim 1 wherein the slots are closed with flexible material.

4. The chain saw bar of claim 1 wherein the slots are generally elongated in the direction parallel with the rail portions.

5. The chain saw bar of claim 1 wherein the bar has a guide groove and ones of the slots extend outwardly beyond the bottom of the groove.

6. In a chain saw bar, a core laminate, and a pair of side laminates secured to the core laminate with rail portions defining a groove with the periphery of the core laminate, the rail portions being so shaped as to have high impact areas, the side laminates having slots therein in areas adjacent the high impact areas of the rail portions, wherein the slots are closed with flexible material.

7. The chain saw bar of claim 6 wherein said material is selected from the group consisting of polyurethane foam plastics, vinyls, leaded vinyls, rubbers, and silicone sealants.

8. A chain saw bar having rail portions and a body portion bounded by the rail portions, the rail portions having high impact areas, the bar having vibration dampening portions interposed between the rail portions and the inner body portion to retard transmission of vibrations from the rail portions to the body portion, said vibration dampening portions comprising slots extending adjacent the rail portions, said slots being disposed in adjacent overlapping relation along said bar such that perpendicular joinder of said rail portions to said body portion by noncompliant saw bar zones is avoided in said vibration dampening portions.

9. The chain saw bar according to claim 8 wherein the slots are generally triangular in shape.

10. The chain saw bar according to claim 8 wherein the slots are closed with flexible material.

11. The chain saw bar of claim 8 wherein the slots are generally elongated in the direction parallel with the rail portions.

12. The chain saw bar of claim 8 wherein the slots are angular with respect to the rail portions with a portion of each slot overlapping a portion of another of the slots.

13. The chain saw bar of claim 8 wherein the slots are elongated and angularly displaced away from an oncoming chain as received on the saw bar and toward the direction of chain travel such that a portion of a slot nearest the saw bar edge will be passed over by the chain after the chain passes over portions of the same slot farther away from the edge of the saw bar.

14. In a chain saw bar,
a core laminate,
and a pair of side laminates secured to the core laminate with rail portions defining a groove with the periphery of the core laminate,
the rail portions being so shaped as to have high impact areas,
the side laminates having slots therethrough disposed in adjacent overlapping relation to one another along said laminates proximate said groove in areas adjacent the high impact areas of the rail portions.

15. The chain saw bar of claim 14 wherein the slots extend outwardly beyond the core laminate.

16. The chain saw bar of claim 14 wherein the slots are arranged in generally parallel rows extending adjacent the rail portions.

17. The chain saw bar of claim 14 wherein the slots are generally elongated.

18. The chain saw bar of claim 14 wherein the slots are elongated and angularly displaced away from an oncoming chain as received on the saw bar and toward the direction of chain travel such that a portion of a slot nearest the saw bar edge will be passed over by the chain after the chain passes over portions of the same slot farther away from the edge of the saw bar.

19. The chain saw bar of claim 14 wherein the slots are generally elongated and constructed of straight and curved sides joined by fillets.

20. The chain saw bar of claim 14 wherein the slots are generally triangular in shape.

21. The chain saw bar of claim 14 wherein the slots are formed in rows generally parallel to the adjacent portions of the rail portions, the slots being generally triangular in shape wherein the slots in each row point toward the other row in intermeshing relationship.

22. The chain saw bar of claim 14 wherein the slots are diamond shaped.

23. The chain saw bar of claim 14 wherein the slots are oval shaped.

24. The chain saw bar of claim 14 wherein the slots are L-shaped.

25. The chain saw bar of claim 14 wherein the slots are S-shaped.

26. The chain saw bar of claim 14 wherein the slots are circular.

27. The chain saw bar of claim 14 wherein the slots are crescent shaped.

28. In a chain saw bar,
a core laminate,
and a pair of side laminates secured to the core laminate with rail portions defining a groove with the periphery of the core laminate,
the rail portions being so shaped as to have high impact areas,
the side laminates having slots therein in areas adjacent the high impact areas of the rail portions,
wherein the slots are formed in rows generally parallel to the adjacent portions of the rail portions, the slots being generally triangular in shape wherein the slots in each row point toward the other row in intermeshing relationship.

29. A chain saw bar having rail portions and a body portion bounded by the rail portions, the rail portions having high impact areas,
the bar having vibration dampening portions interposed between the rail portions and the inner body portion to retard transmission of vibrations from the rail portions to the body portion, said vibration dampening portions comprising a truss-like structure having openings bounded by edge members angularly related to said rail portions such that perpendicular joinder of said rail portions to said body portion by noncompliant saw bar zones is avoided in said vibration dampening portions.

30. The chain saw bar according to claim 29 wherein said edge members repeat a triangular configuration such that said openings are generally triangular in shape.

* * * * *